US006193395B1

(12) United States Patent
Logan

(10) Patent No.: US 6,193,395 B1
(45) Date of Patent: Feb. 27, 2001

(54) ADJUSTABLE LAMP ASSEMBLY FOR INDUSTRIAL EMERGENCY FIXTURES

(75) Inventor: Mark C. Logan, Doraville, GA (US)

(73) Assignee: NSI Enterprises, Inc., Atlanta, GA (US)

( * ) Notice: Subject to any disclaimer, the term of this patent is extended or adjusted under 35 U.S.C. 154(b) by 0 days.

(21) Appl. No.: 09/298,299

(22) Filed: Apr. 23, 1999

(51) Int. Cl.[7] ..... F21V 14/02
(52) U.S. Cl. ..... 362/285; 362/269; 362/287
(58) Field of Search ..... 362/269, 285, 362/287, 418, 427, 187, 364

(56) References Cited

U.S. PATENT DOCUMENTS 4,447,863 * 5/1984 Fenne ..... 362/287
5,605,394 * 2/1997 Chen ..... 362/427
6,019,477 * 2/2000 Wegrzyn et al. ..... 362/287

* cited by examiner

*Primary Examiner*—Y. Quach
(74) *Attorney, Agent, or Firm*—Kenneth E. Darnell

(57) ABSTRACT

A lamp assembly adjustable between narrow beam and wide beam light distributions, the lamp assembly is particularly intended for housing lamping or the like for mounting to industrial emergency unit fixtures of differing size and conformation. At least one and preferably two of the lamp assemblies are mounted to a unit fixture in spaced relation to illuminate critical areas within an industrial or commercial space during emergency conditions, such as failure of mains power, to allow evacuation of the space. In order to illuminate the desired areas, each of the lamp assemblies can be adjusted along an internal track to allow light to be directed toward a particular location within a wide range of possible locations, thereby facilitating illumination of the most desirable area in the vicinity of the unit fixture for a particular mounting location. Additional flexibility in the delivery of illumination to a desired area is provided by adjustability between narrow and wide beams.

29 Claims, 12 Drawing Sheets

ADJUSTABLE LAMP ASSEMBLY FOR INDUSTRIAL EMERGENCY FIXTURES

BACKGROUND OF THE INVENTION

1. Field of the Invention

The invention relates generally to emergency unit lighting fixtures and particularly to lamp assemblies usable with such fixtures and which are both adjustable as to the direction in which light is directed and as to beam width.

2. Description of the Prior Art

Emergency unit lighting fixtures have long been known in the art and have long been required by code for illumination of egress pathways, doorways and the like for facilitating evacuation of a building, typically a commercial or industrial space within a building, during emergency conditions which usually are accompanied by failure of mains power supply resulting in loss of usual illumination sources. Emergency unit fixtures typically take the form of a housing within which an emergency power supply, usually batteries, and circuitry are disposed for driving one or more lamps mounted to the exterior of the housing. In most typical unit fixtures, a pair of lamps are mounted to the top of a unit housing with each lamp being directed forwardly and to the side of that side of the housing on which the lamp is mounted. Such unit figures are often referred to as "frog eyes" and typically do not include a "legend" as do exit signs, thereby allowing use of unit fixtures in locations inappropriate for an exit sign. Further, a unit fixture is intended to provide a usable amount of light, such as along a hallway or the like, to enable a person evacuating a space to follow a preferred pathway out of that space. As disclosed by Edstrom in U.S. Pat. No. 4,422,069, the external lamps of such unit fixtures provide illumination incident on desired surfaces so that a person evacuating the space within which an emergency exists will be able to see a pathway or an exit inter alia. Typical unit fixtures are disclosed by Heffner et al in U.S. Pat. No. 4,218,725.

Emergency unit fixtures have primarily found use in commercial environments which have previously included industrial environments. However, in spite of prior usage of this type of lighting fixture in industrial environments, a need has continued to exist for improved emergency unit fixtures mountable virtually anywhere within an industrial environment and lamped with illumination sources having desirable characteristics. Further, a need exists in the art for emergency unit fixtures useful in industrial environments whereby light from appropriate lamping can be directed to a particular location within a wide range of possible locations within the industrial space proximate to the unit fixture. Still further, need has existed for control of a light beam emanating from lamping of an emergency unit fixture so that the beam can be adjusted between narrow and wide beam conformation. The present invention provides emergency unit fixtures capable of withstanding the abuse typically encountered in industrial environments, the unit fixtures being mountable to a variety of structure within the industrial environment and further being comprised of at least one lamp assembly movable relative to a housing of the fixture in a swiveling motion and further being movable along an internal track within the assembly to allow light emanating from the lamp assembly to be directed as desired to illuminate a particular area chosen for criticality in evacuation of the industrial space or for some reason of importance. The illuminating beam provided by the lamp assemblies of the invention can be adjusted between narrow beam and wide beam light distributions to provide flexibility in operation of the emergency unit fixtures so configured.

SUMMARY OF THE INVENTION

The invention provides an emergency lighting unit fixture particularly useful in industrial environments and which provides "unit" emergency lighting by the disposition of one or more lamp assemblies mountable to any one of a variety of unit fixture housings of different size and conformation. Lamping is mounted by a lamp holder capable of swiveling movement which allows movement of the lamp assemblies with a very substantial degree of freedom to facilitate illumination of particular areas proximate to the fixture. Internal track elements formed within each lamp assembly allows additional adjustment of the lamp assembly in order to direct light toward desired locations within a wide range of possible locations. The structure of at least certain of the elements forming each lamp assembly is spherically concentric thus yielding a compact profile which is attractive in appearance and is further functional due to volumetric efficiency inter alia.

Illumination provided by a preferred embodiment of the present lamp assemblies when in use with industrial emergency unit fixtures is flexible in its application to a desired area to be illuminated due to the ability of the present lamp assemblies to be adjusted between narrow and wide beam conformations. In essence, the beam emanating from each lamp assembly can be adjusted between narrow and wide beam in order to provide a desired type and intensity of lighting to an area which is to be illuminated. Adjustment of beam width is readily and rapidly accomplished by simple manual manipulation of an external bezel which also holds a lens and reflector to an assembly housing, the bezel being movable along sloped tracks formed integrally on exterior surfaces of the lamp housing and under spring pressure in order to adjust beam width. Accordingly, beam width can be adjusted as desired for a given illumination situation with a given lamp assembly on one unit fixture being differently adjusted from the adjustment of any other lamp assembly carried by said unit fixture. Between given limits of narrow and wide beam positions, the lamp assembly is essentially infinitely adjustable.

The emergency unit fixtures described herein as well as the adjustable lamp assemblies operable with said fixtures are preferably formed of polymeric material such as polycarbonate/ABS, thereby allowing molding of fixture housings with most of the structural elements necessary to produce the functions of the fixture being integrally formed with the housing, these molded structural elements and other structure contained within said housings being located within the housings in a manner whereby the structural elements combine to produce synergistic effects in addition to the primary functions of the structural elements, the fixtures being totally integrated as to structure and function as well as being substantially integral in construction. In particular, a variety of unit fixture housings of differing size and conformation can be formed with substantially circular openings of a size which will accept and receive for mounting within the opening a lamp assembly according to the invention, it thus being possible to configure the lamp assemblies in a consistent manner as to structure and function so that the lamp assembly can be employed with unit fixtures of differing sizes and structural design.

U.S. Pat. No. 5,797,673, to Logan et al, describes lighting assemblies for use with a combination lighting unit/exit sign or with lighting unit fixtures wherein lamps are mounted by lampholders capable of swiveling and other motion to provide a substantial degree of freedom for lamping used with a "combination" fixture or with emergency unit fixtures. The lamp assemblies of this invention can be used with the "combination" fixture of this patent. The disclosure of U.S. Pat. No. 5,797,673 is incorporated hereinto by reference.

Accordingly, it is an object of the invention to provide a lamp assembly particularly intended for use with an industrial emergency unit fixture including fixtures of differing sizes and conformations, the lamp assembly of the invention being capable of movement relative to a housing of any one of said fixtures to facilitate illumination of a desired area in the vicinity of the unit fixture.

It is another object of the invention to provide a lamp assembly usable for producing illumination when in use with an emergency unit fixture, the lamp assembly being configured to provide flexibility in delivery of illumination to a desired area through adjustment of the light beam emanating from said lamp assembly between differing beam widths.

It is a further object of the invention to provide an emergency unit fixture particularly intended for use in an industrial environment and with lamping carried by a lamp assembly mounted on exterior portions of the fixture, at least one of the lamp assemblies being carried by the unit fixture and being displaceable by a swivel mounting arrangement as well as along a track formed integrally with said assembly to provide an extraordinary range of movement of lamping within a compact profile.

Further objects and advantages of the invention will become more readily apparent in light of the following detailed description of the preferred embodiments.

DESCRIPTION OF THE PREFERRED EMBODIMENTS

Figure 1:
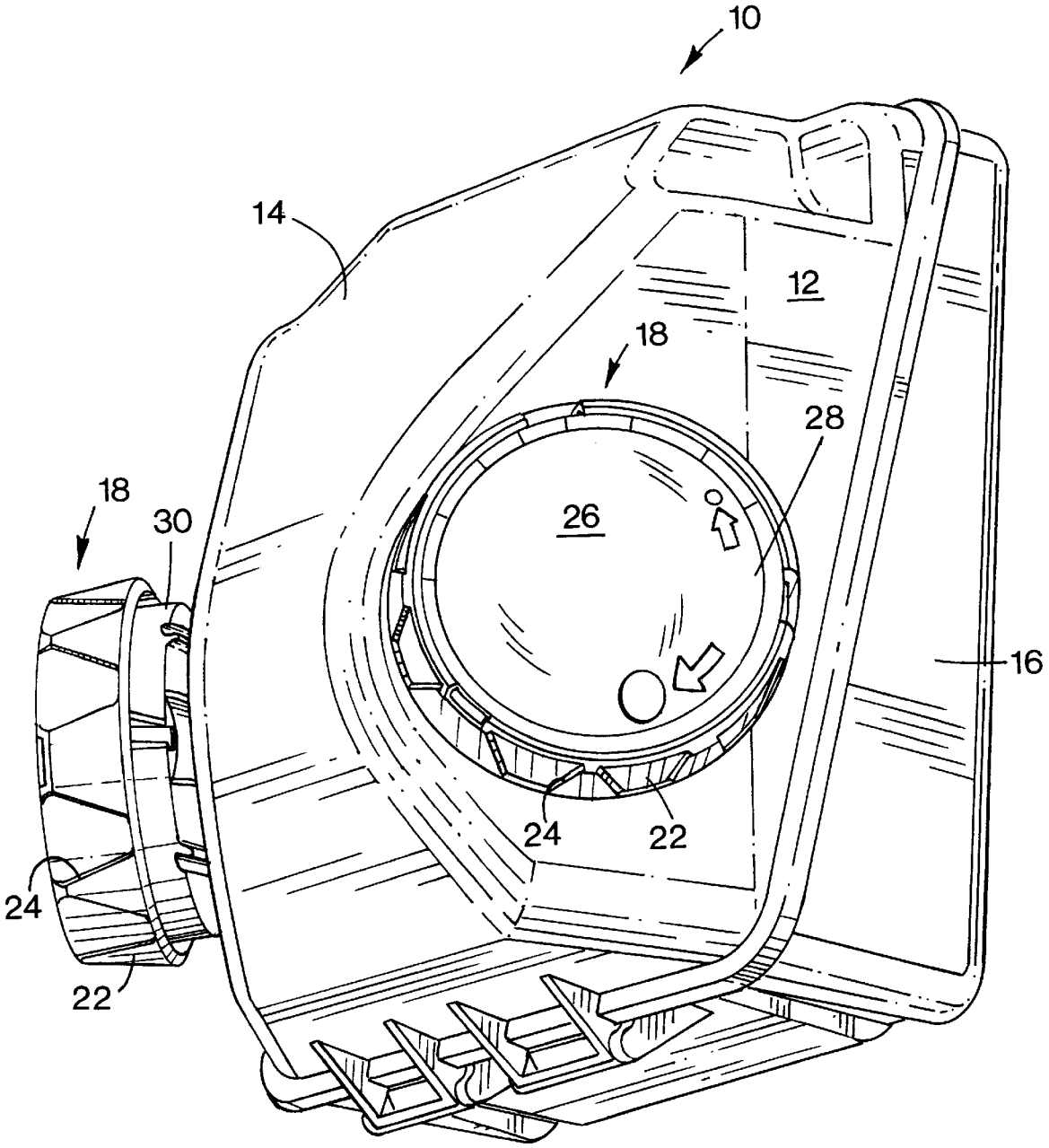
FIG. 1 is a perspective view of an industrial emergency unit fixture illustrating the location of lamp assemblies according to the invention mounted to a housing comprising said fixtures.

Referring now to the drawings and particularly to FIGS. 1 through 4, an industrial emergency unit fixture is seen at 10, this fixture 10 being mountable to structure generally available in an industrial environment as is disclosed in co-pending U.S. patent application Ser. No. 09/298,305 entitled "Universal Mounting Device for Industrial Emergency Unit Fixtures", filed Apr. 23, 1999, and assigned to the present assignee, the disclosure of which patent application is incorporated hereinto by reference. The unit fixture 10 is seen to be comprised of a housing 12 formed of a cover 14 and a base 16 which are hinged together. The housing 12 carries within its interior the circuitry (not shown) and similar elements necessary to production of the function of the fixture 10. In particular, a source of electrical power such as batteries (not shown) is carried within the housing 12 preferably at lower portions thereof The nature of and the operation of those elements carried within the housing 12 can be essentially conventional and form no particular part of this invention. However, it is to be understood that the power supply typically located within the housing 12 is operatively connected to one or more lamp assemblies 18 to energize lamping 20 (first shown in FIG. 6), energization of the lamping 20 being substantially conventional and typically accomplished through wiring such as wiring 44 seen in FIGS. 6 and 7 between the power source (not shown) and the lamping 20.

In operation, the fixture 10 is understood to be mounted, typically in an overhead location, so that beams of light can be directed from the lamp assemblies 18 to illuminate particular locations within an area proximate to the fixture 10. After installation of the fixture 10, the direction in which the lamp assemblies 18 are turned is a matter of choice depending upon the exigencies of the installation, it being only necessary to grasp the lamp assembly 18 such as by holding bezel 22 to swivel the lamp assembly 18 in a desired direction and to move the lamp assembly 18 along an internal track (not shown in FIGS. 1 through 4) to cause the lamp assembly 18 to direct light in a desired direction. Further, in the preferred embodiment of FIGS. 1 through 14, the bezel 22 can be rotated to produce an "infinitely" adjustable beam width in the range between a pre-set wide beam adjustment position and a pre-set narrow beam adjustment position as will be described hereinafter. Accordingly, the beam width characteristics of the light emanating from the respective lamp assemblies 18 can be adjusted as to beam width. The bezel 22 is provided with knurls 24 which facilitate grasping of the bezel 22. The bezel 22 further mounts lens 26 which can be provided with indicia 28 thereon to denote the direction of rotation of the bezel 22 necessary to produce a narrow beam as indicated by a small diameter circle and a wide beam as indicated by a larger diameter circle.

Figure 2:
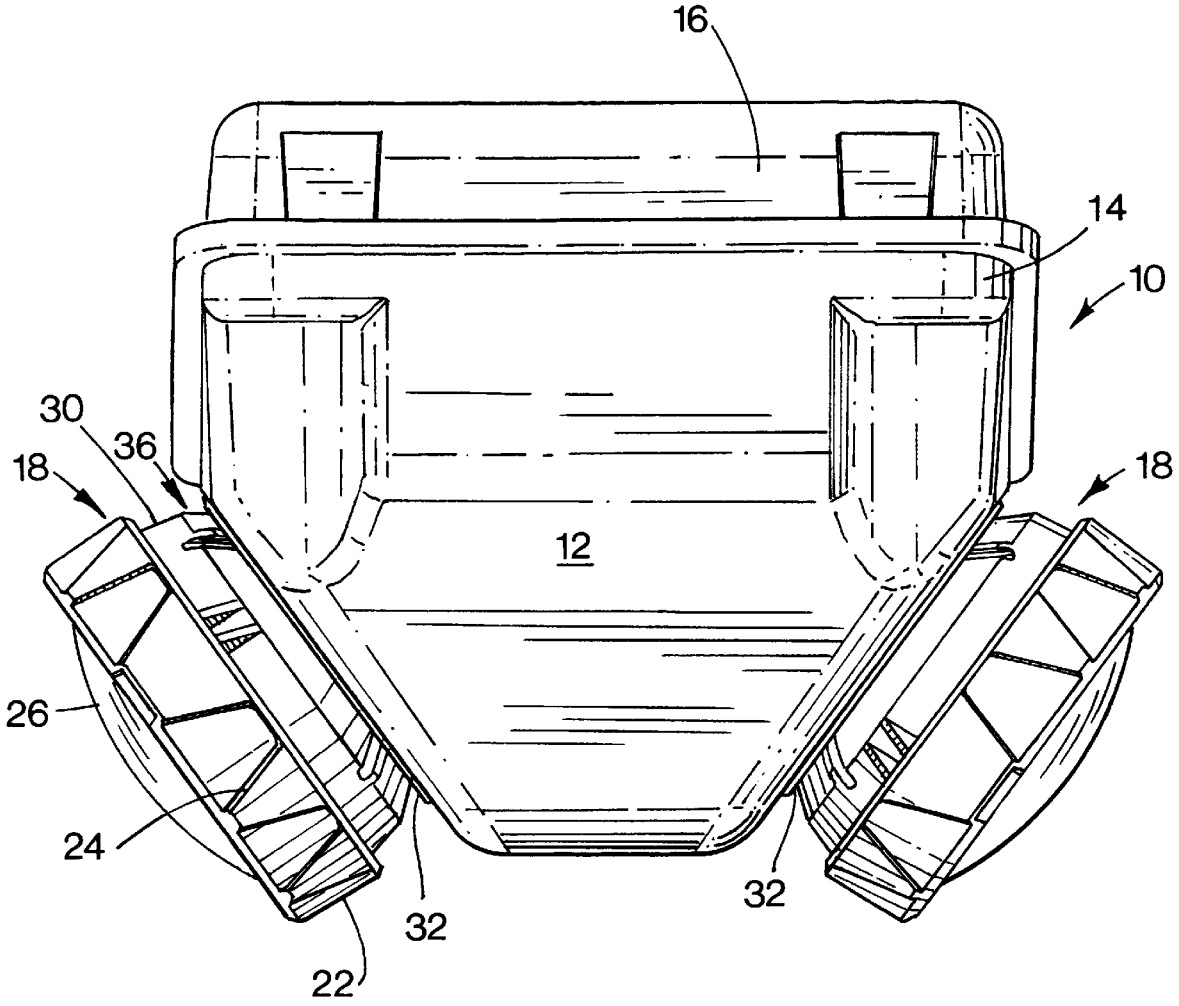
FIG. 2 is a plan view of the fixture of FIG. 1.
Figure 3:
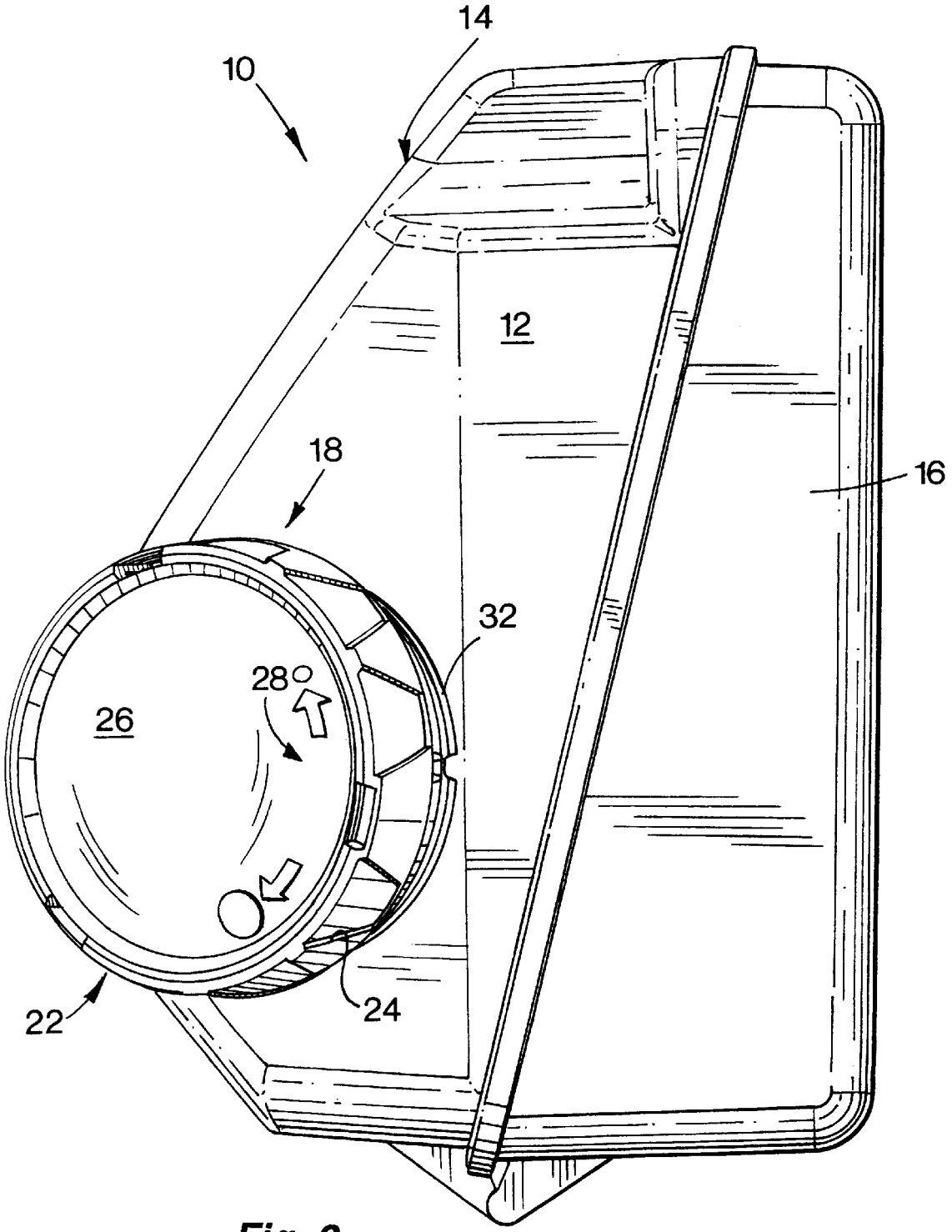
FIG. 3 is an elevational view of the fixture of FIG. 1.

As can generally be seen in FIGS. 1 through 3, the bezel 22 is mounted to lamp assembly housing 30, the housing 30 mounting the bezel 22 for rotary movement thereon between spaced limits as will be described hereinafter. The lamp assembly housing 30 is then in turn mounted for movement along a track arrangement (not shown in FIGS. 1 through 3) for movement between limited positions relative to a swivel plate 32 which is received for swiveling movement within an enlarged aperture 34 such as is seen to be formed in the cover 14 illustrated in FIG. 4. The swivel plate 32 is formed as a spherical segment which is concentric with a substantially spherical rear wall 36 of the lamp assembly housing 30, the spherically shaped rear wall of the housing 30 essentially being received into the concentrically formed spherical concavity of the swivel plate 32 as will be described in greater detail hereinafter relative to those drawing figures which illustrate in greater detail the structure of the swivel plate 32 inter alia. The degree of movement afforded to the lamp assemblies 18 by the structure thus alluded to allows ready positioning of the lamp assemblies 18 in order to direct light forwardly, downwardly and to the sides of the fixture 10 in order to produce a desired level of illumination at a desired location within an environmental space such as an industrial space under emergency conditions.

Figure 4:
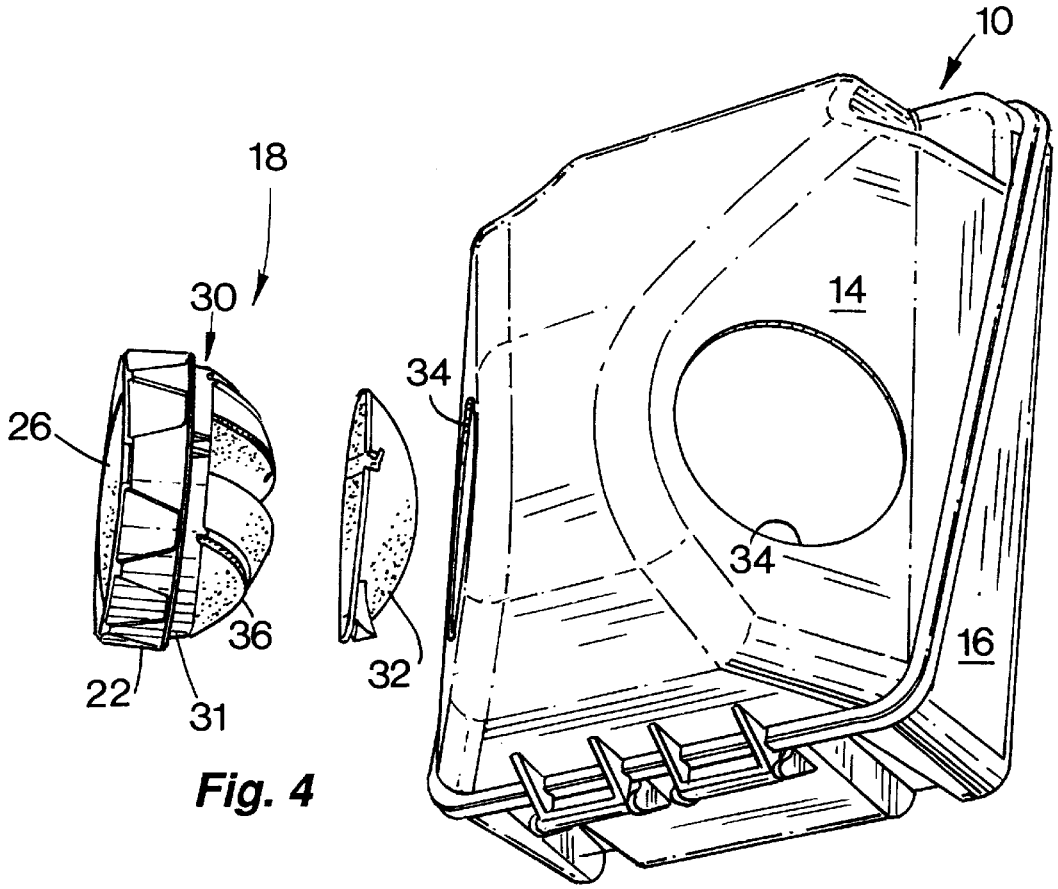
FIG. 4 is an exploded assembly view of the fixture of FIG. 1 illustrating a single lamp assembly shown in an exploded relationship to the housing of the fixture and with a location on the housing of the unit fixture suitable for receiving a second lamp assembly having no lamp assembly in place.
Figure 5:
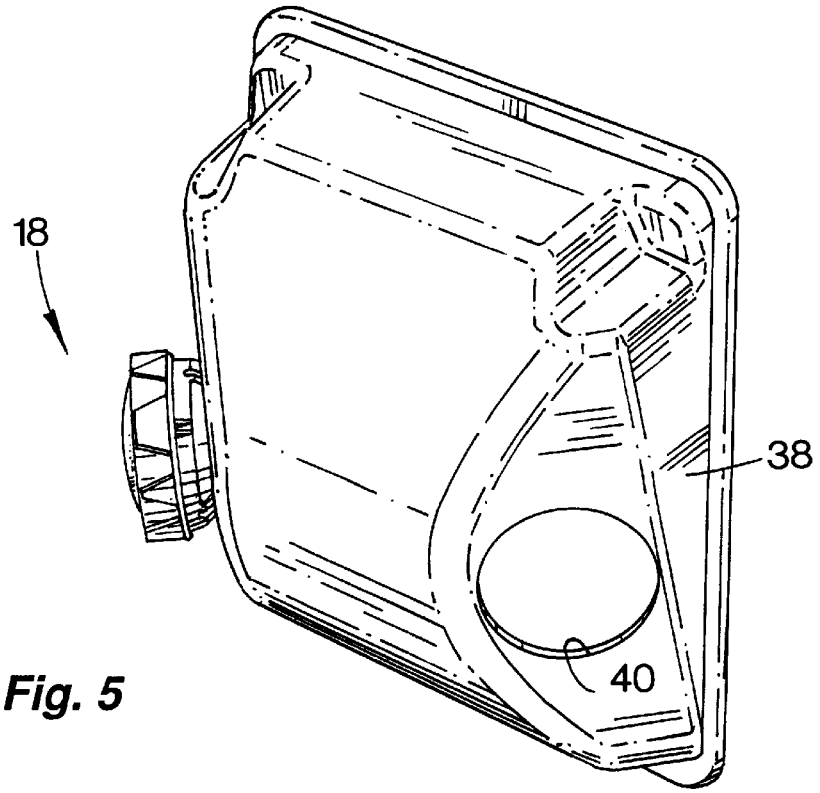
FIG. 5 is a perspective view of a portion of a housing of an industrial emergency unit fixture of larger size than the fixture shown in FIGS. 1 through 4 and illustrating the location of mounting of lamp assemblies configured according to the invention.

Referring now to FIG. 5, a housing cover 38 is shown separately from remaining portions of an emergency unit fixture which is of a larger size than the fixture 10 seen in FIGS. 1 through 4 and is of a differing conformation. The housing cover 38 is shown as an example of the differing sizes and conformations of emergency unit fixtures which can be fitted with the lamp assemblies 18 of the invention, it being seen in FIG. 5 that an aperture 40 is provided in the cover 38 which is of a diameter essentially identical to that of the aperture 34 formed in the cover 14 of the housing 12. One of the lamp assemblies 18 is fitted into the aperture 40 of the cover 38 in a manner identical to the fitting of one of the lamp assemblies 18 into the aperture 34 of the fixture 10. Whether carried by an emergency unit fixture such as the fixture 10 or a fixture having the housing cover 38 as a portion thereof, the lamp assemblies 18 exhibit essentially the same degree of movement and find essentially the same utility. The lamp assembly 18 can therefore be seen to be usable in light fixtures of various description without departing from the intended scope of the invention.

Figure 6:
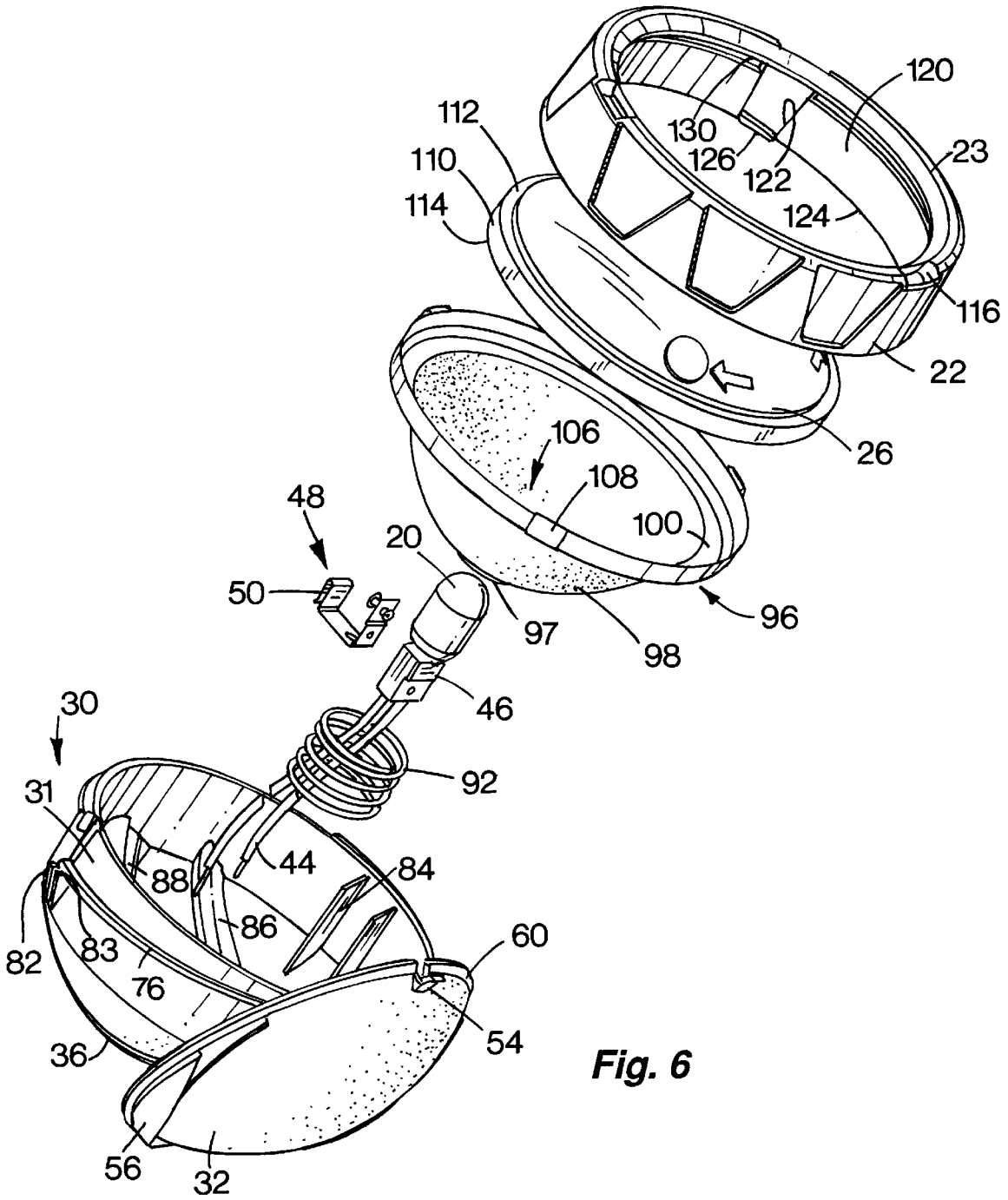
FIG. 6 is an exploded view of a lamp assembly configured according to the invention.

Referring now to FIGS. 4, 6 and 11 through 14, the structure of the various elements forming any one of the lamp assemblies 18 can be understood. The swivel plate 32, seen particularly in FIGS. 14*a* through 14*d* as well as in the exploded views of FIGS. 4 and 6, is concavely formed as aforesaid and has an aperture 42 formed therein to receive electrical wiring 44 therethrough as is best seen in FIG. 14*a*. The wiring 44 connects at its free end as best seen in FIG. 6 to a standard lamp mount 46 which mounts the lamping 20, the lamping 20 being a bulb of conventional design. The lamp mount 46 is physically connected to a metal bracket 48 which can include a friction loop clamp 50 which fits over a substantially rectangular mounting plate 52 (see FIG. 13*c*) for mounting the lamping 20 to the interior of the housing 30 and centrally therewithin. The clamp 50 is optional and the bracket 48 can be directly mounted such as by a screw (not shown) to other structure. The other end of the wiring 44 extends into the interior of the housing 12 and connects to a source of power for energization of the lamping 20 as determined by circuitry (not shown) which comprises a part of the fixture 10.

The swivel plate 32 fits into the aperture 34 formed in the housing 12 by means of a mounting tab 54 which is received into the aperture 34 with spaced ramps 56 essentially disposed on the other side of the swivel plate 32 being then received into the aperture 34 with the swivel plate 32 then being displaced into the aperture 34 with the ramps 56 following the contours of portions of the aperture 34 to cause edge portions of the cover 14 defining the aperture 34 to be received into arcuate slots 58 formed one each in each one of the ramps 56 to securely mount the swivel plate 32 in the aperture 34 with a peripheral rim 60 acting to provide a "finishing" flange about the aperture 34. The curvature of the ramps 56 essentially comprise circular arcs having a radius which is slightly less than the radius of substantially circular swivel plate 32 at free ends of the ramps 56. The radii of the ramps 56 at inwardly disposed portions nearmost the slots 58 are essentially identical to the radius of the rim 60 in order to allow a secure snap-fitting of the swivel plate 32 in place in the aperture 34.

The concave face of the swivel plate 32 is provided with a pair of inwardly directed, ridge-like track following tabs 62 mounted apart by one/half radian or approximately ¼ of the circumference of the swivel plate 32, the tabs 62 being integrally formed in concave face 64 of the plate 32. The tabs 62 are angled from a radius drawn to either end of the tabs 62. The tabs 62 fit into trough-like tracks 66 formed over at least a portion of the spherical rear wall of the lamp assembly housing 30, the tabs 62 being shaped to move within said tracks 66 to allow the housing 30 to move in an arc along a substantially radial direction relative to the swivel plate 32. The tracks 66 essentially comprise arcuate grooves. Movement of the housing 30 relative to the swivel plate 32 is limited by a stop 68 formed essentially equidistantly between the tabs 62, the stop 68 essentially comprising a substantially rectangular wall-like element, the body of which wall-like element lies in a plane parallel to that chord of the circular swivel plate 32 formed by connecting the ends of the tabs 62 which intersect that circle defining the swivel plate 32.

The stop 68 is preferably integrally formed on the concave face 64 of the swivel plate 32. The stop 68 abuts against a depressible tongue 70 which is integrally formed in the rear spherical wall 36 of the housing 30 essentially equidistantly between the tracks 66. The tongue 70 is essentially rectangular in conformation and surmounts a slot 72 formed in the wall 36 of the housing 30, the tongue 70 being depressible into the slot 72 to facilitate initial mounting of the housing 30 to the swivel plate 32. Abutment of the stop 68 of the swivel plate 32 against the free end of the tongue 70 prevents further relative movement in the direction of the tongue 70 between the swivel plate 32 and the lamp assembly housing 30. An arcuate and elongated trough 74 formed centrally in the rear spherical wall 36 of the housing 30 and in alignment with the longitudinal axis of the tongue 70 allows the stop 68 of the swivel plate 32 to move therealong and thus allows the housing 30 to move relative to the swivel plate 32 as the track-following tabs 62 of the plate 32 move within the tracks 66 of the housing 30.

The lamp assembly housing 30 can also be further seen in FIGS. 4, 6 and 13*a*–13*d* to be formed with a cylindrical body portion 31 which is open at one end and enclosed at its other end by the rear spherical wall 36. Exterior walls of the cylindrical body portion 31 have three arcuate ramps 76 formed thereon and preferably integrally therewith, each of the ramps 76 being approximately ⅓ the circumference of the geometrical base of the cylindrical body portion 31. Each of the ramps 76 begins at rim 78 of the open end of the housing 30 and extend downwardly essentially in the manner of a screw thread toward the rear of the housing 30 with each ramp terminating at a location of approximately one-half the height of the cylinder defined by the cylindrical body portion 31. Each ramp 76, therefore, essentially begins at the rim 78 at a location essentially "above" the termination of an adjacent ramp 76. Each ramp 76 is turned inwardly at its outermost end to form a stop tab 80 at the rim 78, the stop 80 preventing further "outward" movement of the bezel 22 relative to the lamp assembly housing 30, this position being the "narrow" beam position. A U-shaped stop 82 is provided at the ends of each of the ramps 76 at the other ends thereof, the stops 82 functioning to limit rotation of the bezel 22 on the housing 30 at the point where adjustment to wide beam is provided. Yokes 83 of the stops 82 provide ledges on which the bezel 22 rests at the "wide" beam position or in the embodiment of FIG. 15.

The ramps 76 receive the bezel 22 onto the housing 30 as will be described hereinafter to allow the bezel 22 to effectively be "screwed" onto the housing 30 much in the way that a lid of a jar is screwed onto "screw threads" of the jar itself. In essence, the arcuate ramps 76 form screw threads on the cylindrical body portion 31 of the lamp assembly housing 30, each of the ramps 76 allowing a displacement of approximately ⅜ inch of the bezel 22 onto the housing 30.

Figure 7:
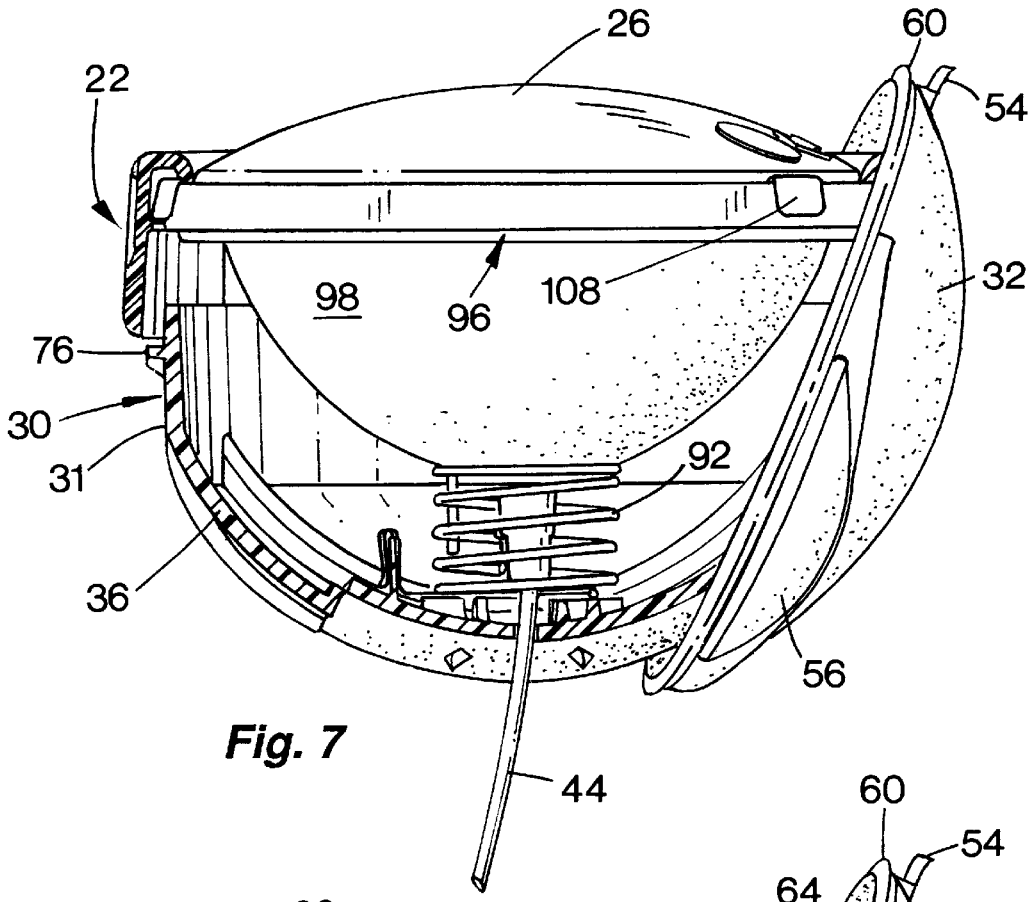
FIG. 7 is a section of an assembled lamp assembly configured according to the invention shown in a narrow beam mode.

Considering now the interior structure of the lamp assembly housing 30, diametrically opposed pairs of projections 84 are integrally formed with the housing 30 and extend substantially along the full height of the cylindrical body portion 31 before terminating into inner wall surfaces of the rear spherical wall 36. The projections 84 index a portion of sealed beam lamp 152 (see FIG. 15) to maintain a horizontal orientation of the asymmetrical light distribution of the lamp 152. Arcuate projections 86 spaced one each on either side of the inner wall surface of the housing 30 comprise that structure in relief which effectively form the tracks 66 referred to hereinabove. Similarly, the reverse side of the trough 74 is seen at 88. Extending from the reverse side 88 of the trough 74 is the mounting plate 52 which receives the friction clamp 50 associated with mounting of the lamp mount 46 as referred to hereinabove. Four pairs of nibs 90 form an effective plane upon which lower portions of a coiled spring 92 sit, the coiled spring 92 also being held in place by four opposed tabs 94 which have inward projections for engaging the spring 92. The spring 92, as also can be seen in FIG. 7, is received over the tamping 20 and against upper surfaces of the nibs 90 as well as against a yoke portion of the bracket 48, an upper end of the coil spring 92 biasing against an innermost portion of a reflector 96. The reflector 96 has a central aperture 97 formed therein for receiving the lamping 20 therethrough. The coil spring 92 is held in tension between the supporting nibs 90 and the underside of the reflector 96.

The reflector 96 is essentially seen to be formed of an elliptical body portion 98 having a peripheral flange 100 defined outwardly by a rim 102 which turns outwardly of the reflector 96 to form an outwardly directed circular flange 104. At spaced intervals about the flange 104, reflector tabs 106 are spaced apart one-third of the circumference of the circle defined by the flange 104. The tabs 106 are substantially U-shaped in conformation with the yoke portions thereof extending outwardly of the reflector with an outward leg 108 of each tab 106 extending back inwardly toward the interior of the housing 30 on assembly as is seen in FIG. 7 in particular.

The lens 26 is formed of a transparent material such as polycarbonate and is formed with an inwardly directed flange 110 which joins to the periphery of the lens 26 by means of a rim 112. Peripheral edge 114 of the flange 110 fits against outwardly disposed surfaces of the peripheral flange 100 of the reflector 96 and effectively rests thereon. The assembly comprising the lens 26 and the reflector 96 is received into the bezel 22 from rearwardly thereof with spaced slots 116 being formed in rim 23 of the bezel 22 for ventilation. The slots 116 are spaced equidistantly from each other about the circular rim 23 and the slots 116 surmount indentations 122 formed in inner wall surfaces of cylindrical body portion 120 comprising the bezel 22. The indentations 122 extend to an inner peripheral edge 124 and are terminated by tabs 126 which extend inwardly of the peripheral edge 124.

Figure 8:
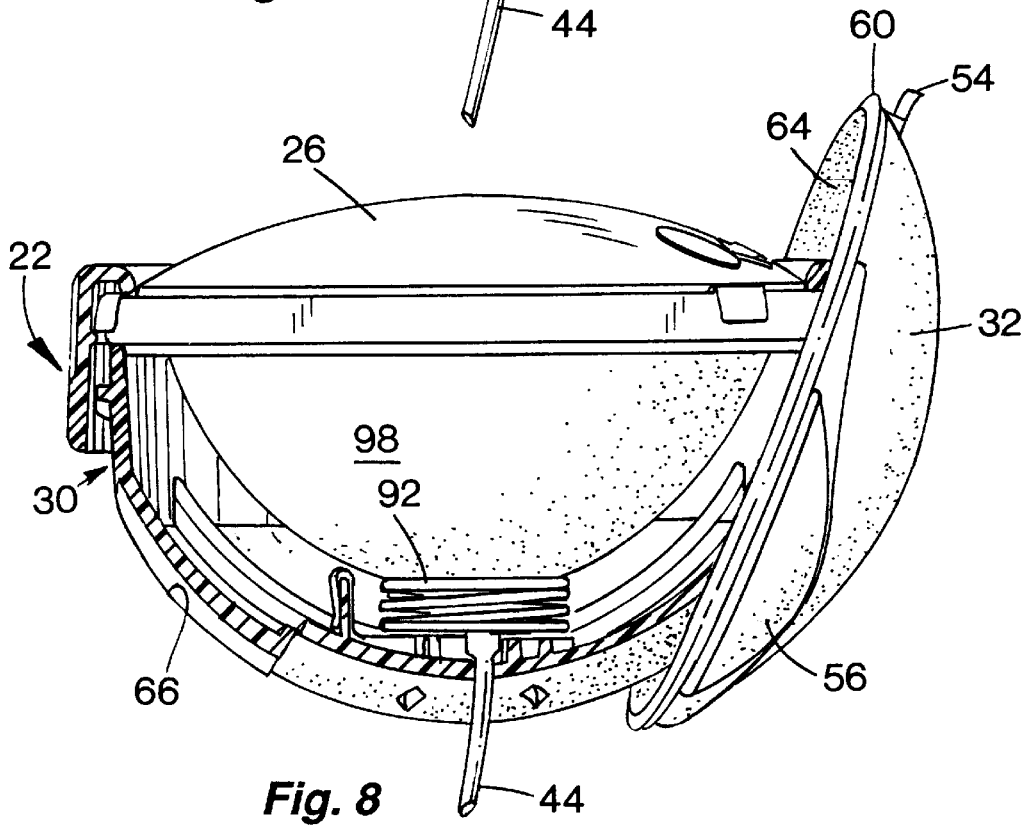
FIG. 8 is a perspective in section of the lamp assembly of the invention shown in a wide beam mode.
Figure 9:
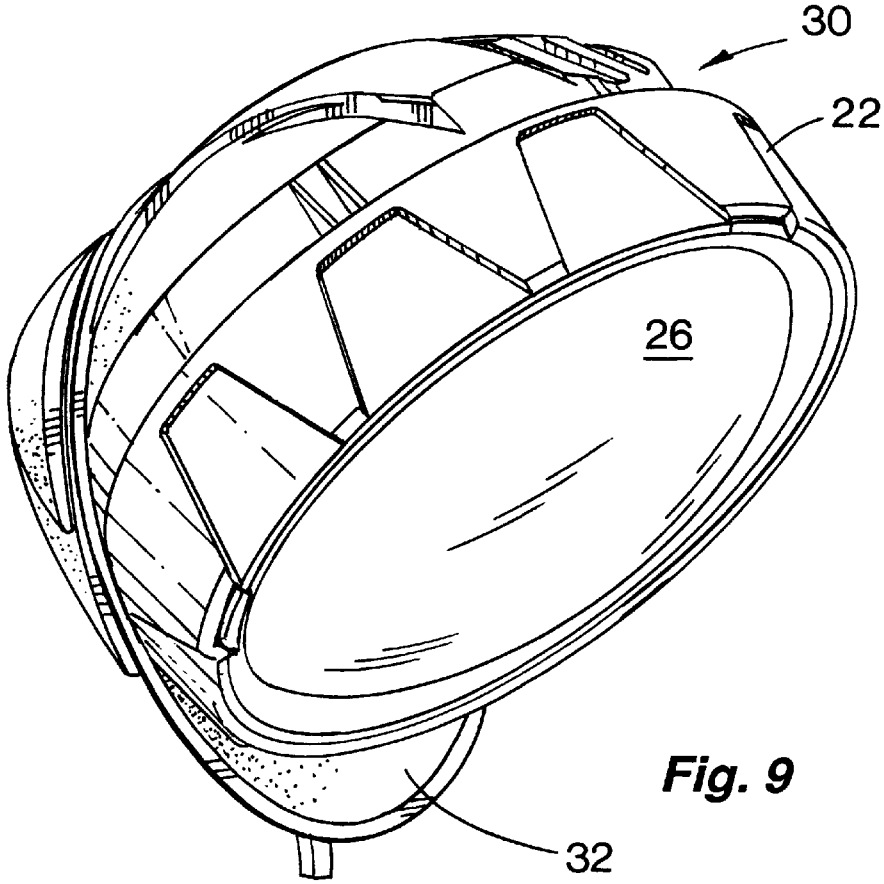
FIG. 9 is a perspective view of a lamp assembly of the invention shown at a full limit of travel along integral tracks.

The tabs 126 also fit against and move along the ramps 76 of the housing 30 to allow the bezel 22 to be rotated relative to the housing 30 to either draw the bezel 122 onto the housing 30 or to cause relative outward movement therebetween. In other words, the bezel 22 can be rotated in one direction to compress the coil spring 92 and therefore move the lamping 20 further away from reflective elliptical surfaces of the reflector 96, thereby providing a full wide beam adjustment. Accordingly, the coil spring 92 is essentially fully compressed by movement of the reflector 96 to compress said coil spring 92 through rotation of the bezel 22 in one direction. Opposite rotation of the bezel 22 relieves tension on the coil spring 92 and causes elliptical reflective surfaces of the reflector 96 to be positioned more closely to the lamping 20, thereby providing a beam which is a full narrow beam adjustment according to the capability of the structure, the narrow beam adjustment being seen in FIG. 7 wherein the coil spring 92 is at its full permitted extension. Rotation of the bezel 22 can be stopped at any location between essentially full compression of the coil spring 92 as seen in FIG. 8 and full permitted extension of the coil spring 92 as seen in FIG. 7. The stops 82 limit rotation of the bezel 22 at the position shown in FIG. 8 while the stops 80 limit rotation of the bezel 22 at the permitted full extension of the coil spring 92 as shown at the narrow beam adjustment position of FIG. 7. Friction existing in the mechanism providing the ability to adjust between narrow and wide beam widths allows adjustment to beam widths between the two extremes. In the absence of sufficient friction, additional frictional capability can be provided by material choice or application of a material having a high frictional coefficient over appropriate portions of the structure described. Stops (not shown) can be provided to cause defined beam adjustment positions to be present in the assembly 18 as an option.

Completing the structure of the bezel 22, the rim 118 is seen to be formed by a flange 128 and an inwardly directed rim 130 which terminates the flange 128, the rim 130 defining the aperture of the lamp assembly 18 through which light is directed. The slots 116 are seen to be primarily formed in the flange 128. Yoke portions of the reflector tabs 106 fit into arcuate spaces or tracks defined by the flange 128 and the rim 130, the tabs 106 being maintained in said spaces to capture the lens 26 and the reflector 96 in place within and relative to the bezel 22.

The structure of the lamp assembly 18 provides for an optimized degree of freedom while allowing a low profile due to the effective extension of at least portions of the rear spherical wall 36 of the housing 30 effectively into the interior of the housing 12. The lamp assembly 18 is therefore compact volumetrically while being adjustable in position over a wide range of motion and further allows for beam adjustment as described in detail herein. The relatively compact structure of the lamp assembly 18 coupled with formation from high impact "plastic" materials causes the assembly 18 to be able to withstand the abuse expected in an industrial environment. Mounting of the lamp assembly into an opening formed directly in the fixture housing 12 contributes substantially to the low profile characteristic of the lamp assembly 18 and the concomitant ability of said assembly 18 to withstand abuse in an industrial environment.

Figure 10:
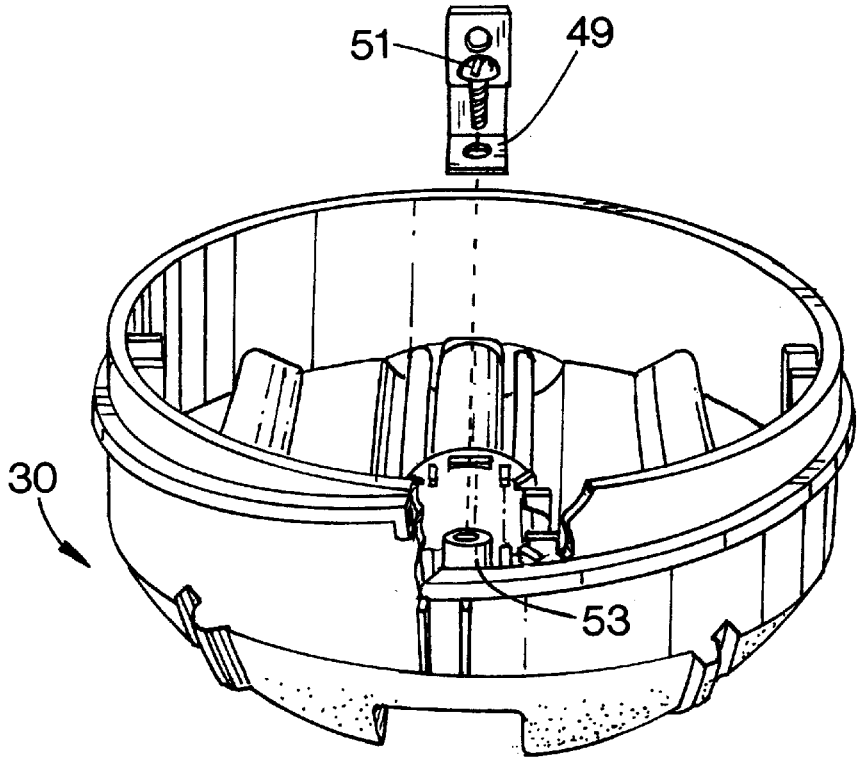
FIG. 10 is a perspective view illustrating a detail of mounting of an alternative bracket arrangement.
Figure 11A:
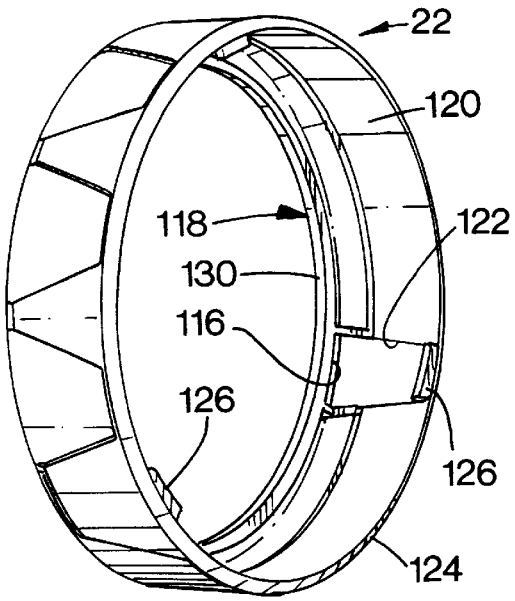
FIGS. 11*a*–11*d* are views illustrating the structure of the bezel element of the lamp assembly.
Figure 11C:
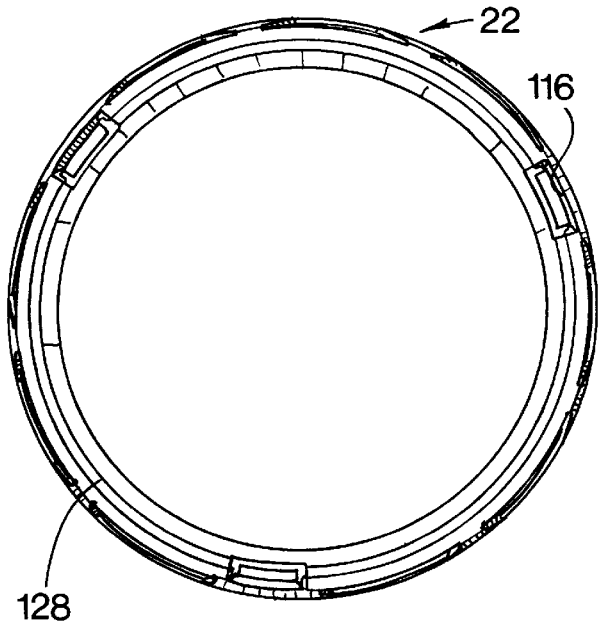
Figure 11B:
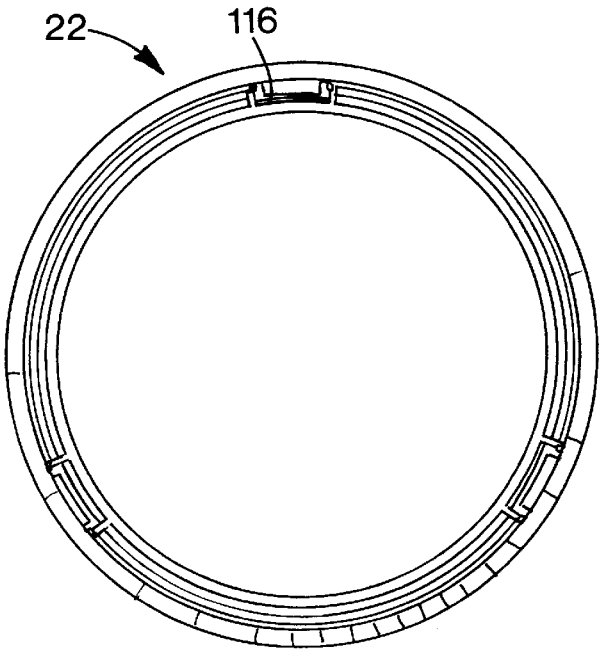
Figure 11D:
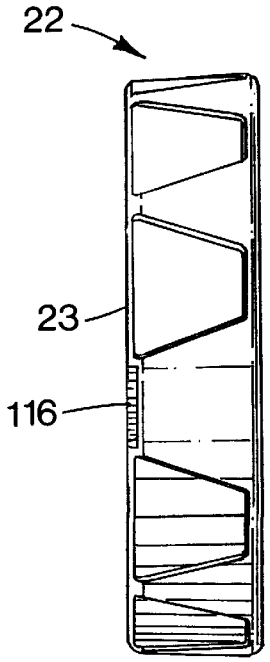
Figure 12A:
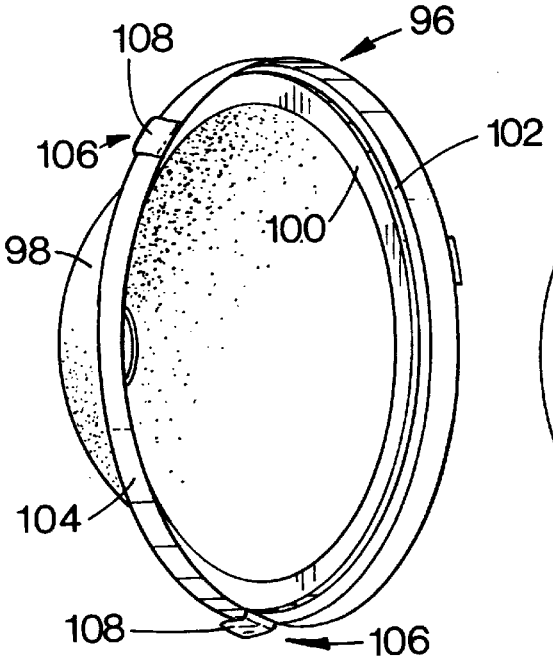
FIGS. 12*a*–12*d* are views illustrating the structure of the reflector element of the lamp assembly.
Figure 12B:
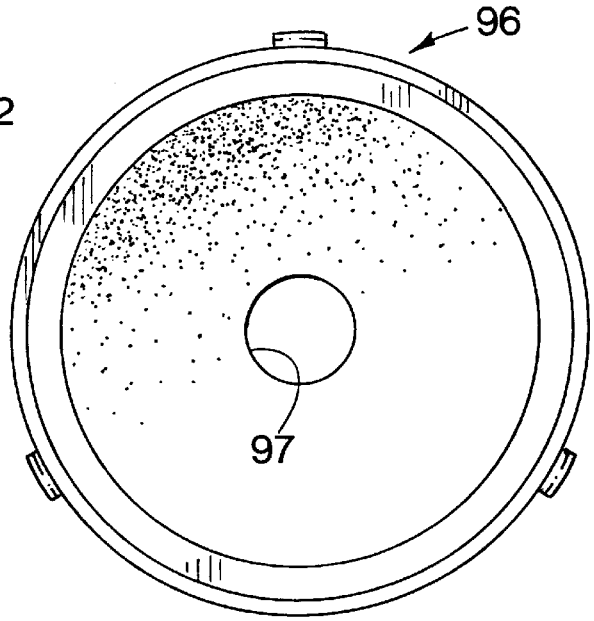
Figure 12C:
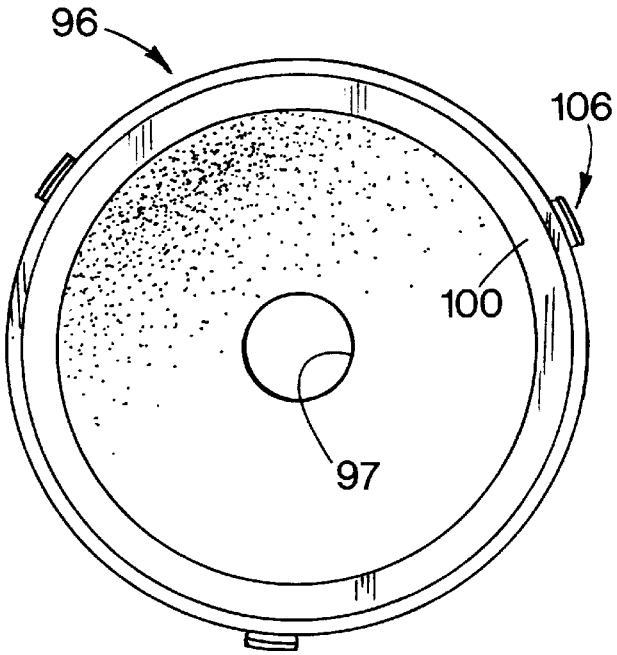
Figure 12D:
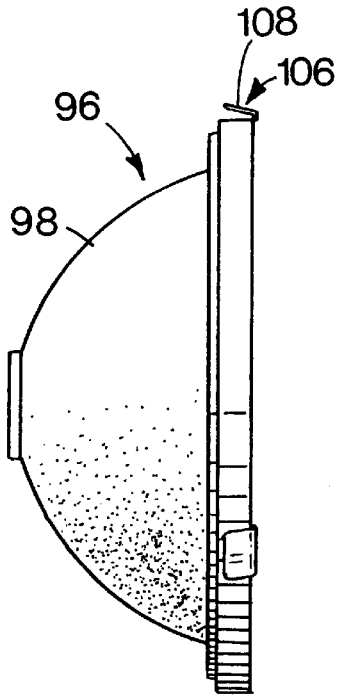
Figure 13A:
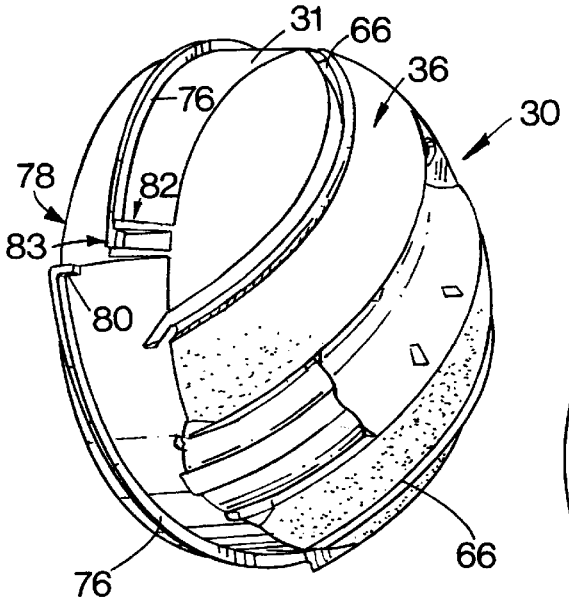
FIGS. 13*a*–13*d* are views illustrating the structure of the housing element of the lamp assembly.
Figure 13B:
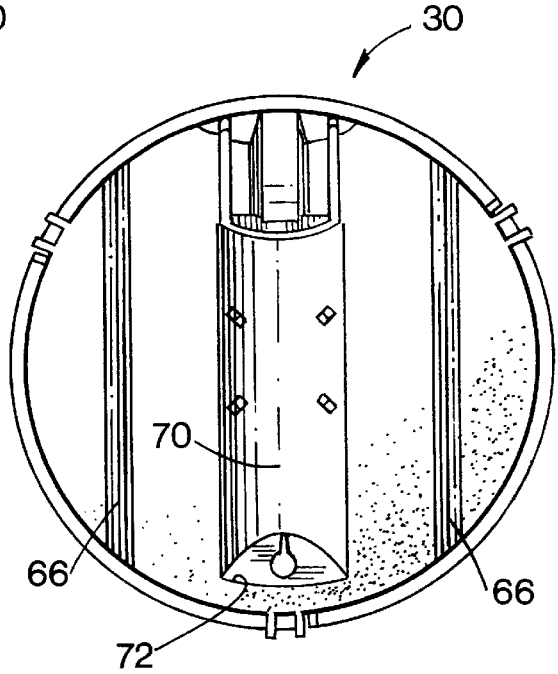
Figure 13C:
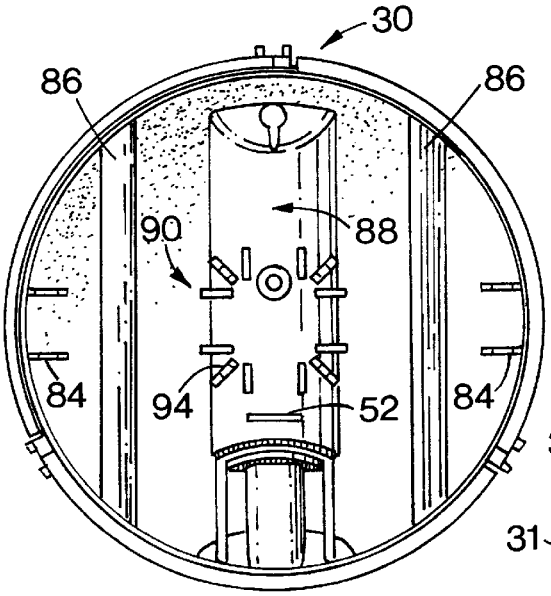
Figure 13D:
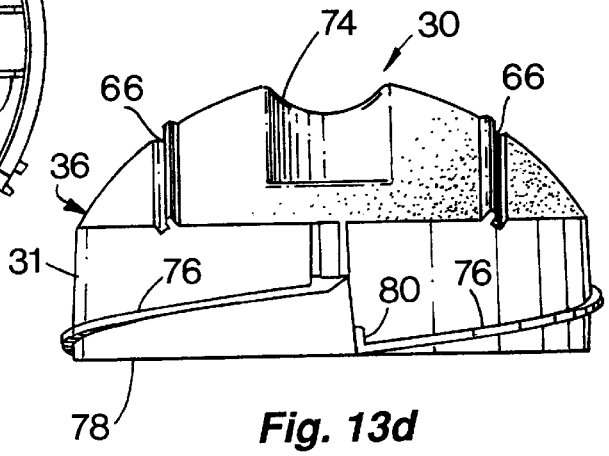
Figure 14A:
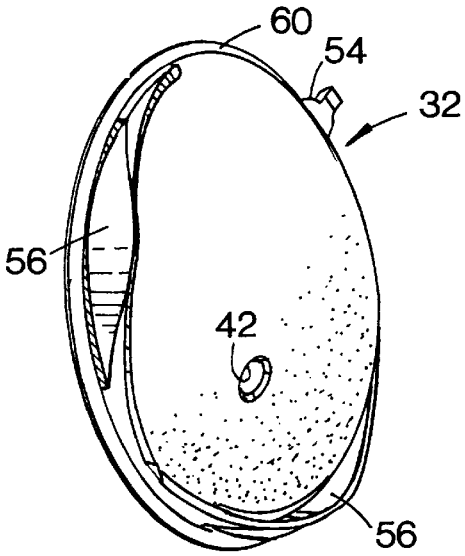
FIGS. 14*a*–14*d* are views illustrating the structure of the mounting element of the lamp assembly; and, FIG. 15 illustrates a sealed beam embodiment of the invention.
Figure 14B:
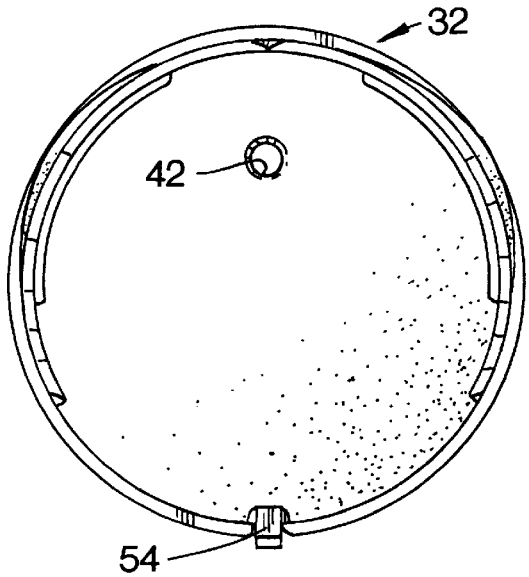
Figure 14C:
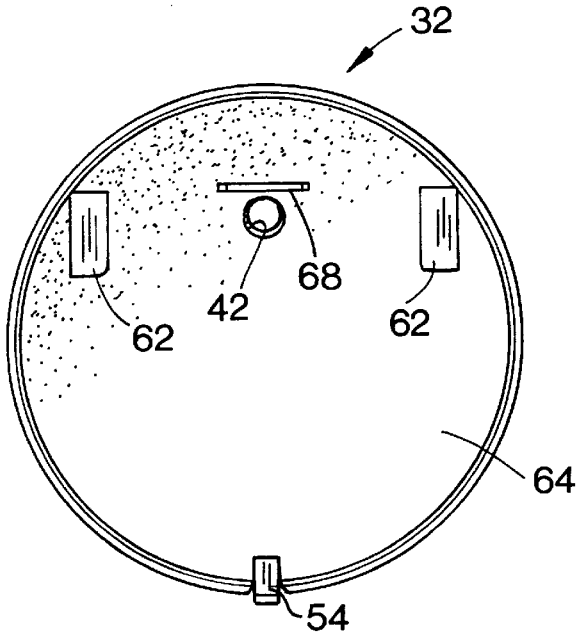
Figure 14D:
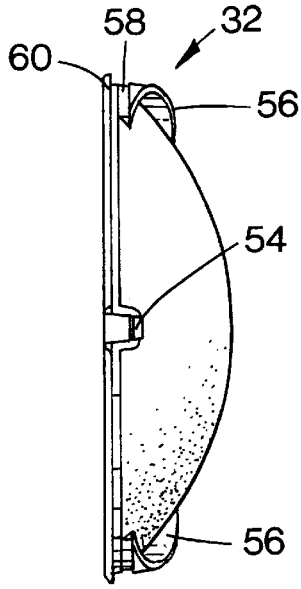

Referring now to FIG. 10, an alternate manner of configuring the metal bracket 48 is shown. Essentially, a strip 49 of metal is shown as being mounted by a screw 51, the screw 51 being received into the top end of a post 53 which is also seen in FIG. 14*b*, the post 53 not being shown in figures other than FIGS. 10 and 14*b*.

Figure 15:
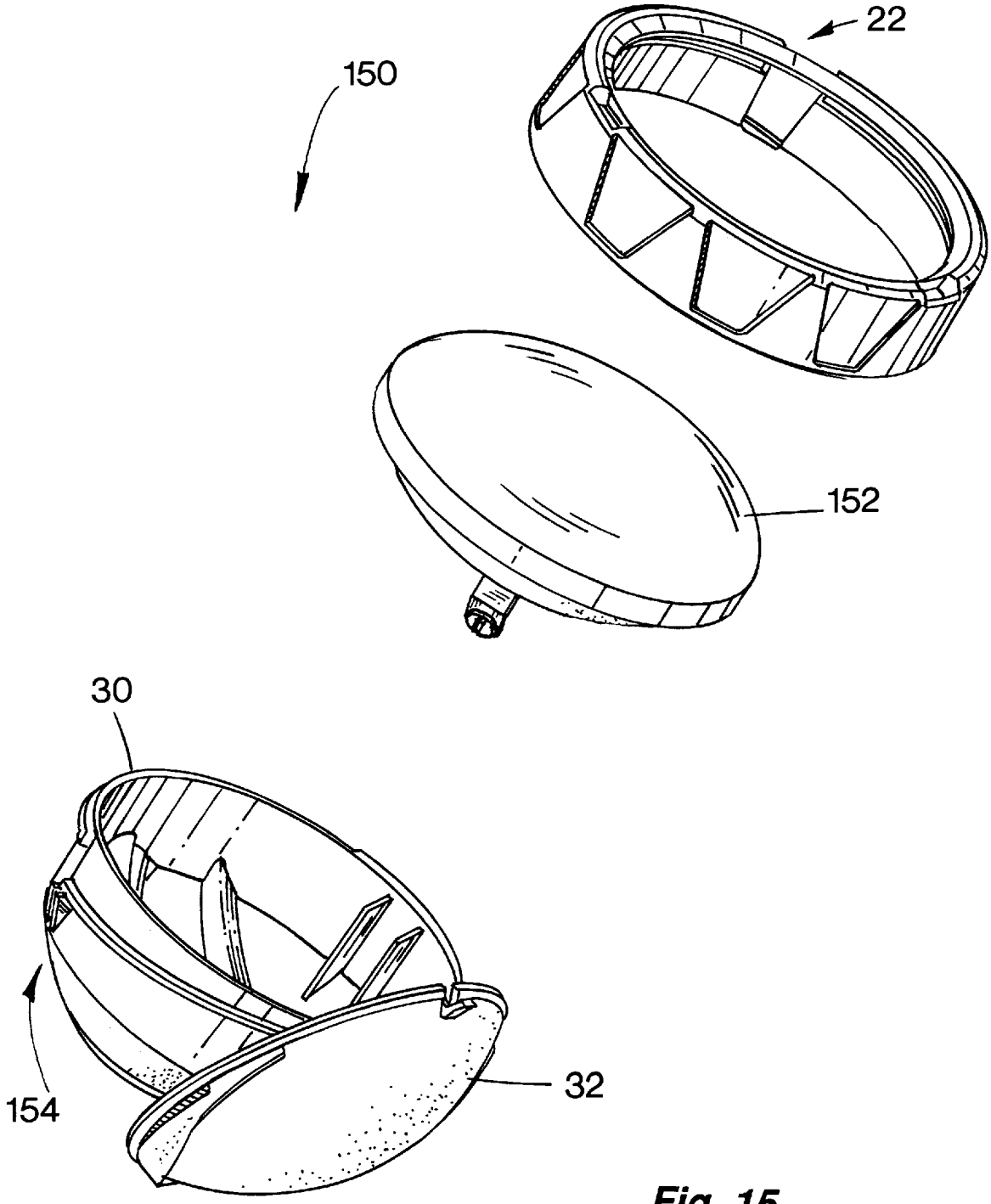

Referring now to FIG. 15, a sealed beam lamp embodiment of the invention is seen generally at 150. The sealed beam lamp embodiment of the invention is seen to be identical to the lamp assembly 18 with the exception that sealed beam lamp 152 is substituted for the lens 26, the reflector 96 and the lamping 20 of the embodiment of FIGS. 1 through 14. Additionally, the coil spring 92 is not employed since the sealed beam lamp embodiment 150 does not provide adjustment of beam width due to the fixed optics of the sealed beam lamp 152. Lamp assembly 154 utilizing the sealed beam lamp 152 continues use of the swivel plate 32, the lamp assembly housing 30 and the bezel 22, the sealed beam lamp 152 being held between and within the bezel 22 and the lamp assembly housing 30, the bezel 22 being tightened onto the lamp assembly housing 30 to the greatest degree possible. The lamp assembly 154 remains capable of all movement which the lamp assembly 18 is capable. Use of the sealed beam lamp 152 allows use of higher wattages in an industrial emergency lighting unit fixture such as the fixture 10.

Particular embodiments of the invention have been described hereinabove in relation to illustrations of preferred emergency unit fixtures. However, it is to be understood that the invention can be embodied other than as is described and shown herein. In particular, the lamp assemblies 18 and 154 of the invention can be formed in cooperative relation with housing structure other than that shown. Accordingly, the scope of the invention is defined by the recitation of the appended claims.

What is claimed is:

1. In an emergency lighting unit fixture having a housing having at least one aperture formed therein, a source of emergency power, a source of illumination and structure capable of sensing an emergency condition and activating the source of emergency power to energize the illumination source, the illumination source being improved by and comprising:

at least one lamp assembly mounted at least partially within the at least one aperture formed in the housing;

swivel means carried by the lamp assembly and mounting the lamp assembly to the housing for swiveling movement relative to the housing;

track means carried by the lamp assembly and mounting the lamp assembly to the swivel means for movement relative to the swivel means; and, means carried by the lamp assembly for adjusting beam widths of illumination emanating from the lamp assembly.

2. In the emergency lighting unit fixture of claim 1 wherein the swivel means comprise:

a swivel plate shaped as a spherical segment and having one face which is concave in conformation, the opposite face of the swivel plate being received substantially within the aperture formed in the housing and being rotatable within the aperture;

mounting means formed integrally with the swivel plate for mounting the plate within the aperture for rotary movement therein; and, track-following means formed integrally with the swivel plate for engagement with and movement along the track means.

3. In the emergency lighting unit fixture of claim 2 and further comprising stop means formed integrally with the swivel plate for limiting motion of the lamp assembly along the track means.

4. In the emergency lighting unit fixture of claim 2 wherein the track-following means comprise arcuate tabs spaced apart with one tab located on one side of the concave face of the swivel plate and with the other tab located on the concave face on the other side of the swivel plate, outermost ends of the tabs intersecting a periphery of the swivel plate, body portions of the tabs extending into the concavity of said face of the swivel plate.

5. In the emergency lighting unit fixture of claim 4 wherein the lamp assembly further comprises a lamp assembly housing having a substantially cylindrical body portion open at one end and a rear wall shaped as a spherical segment congruent with the shape of the concave face of the swivel plate, the track means comprising arcuate spaced grooves formed in the rear wall of the lamp assembly housing, each one of the arcuate tabs being received in one each of the arcuate grooves, the lamp assembly housing being movable relative to the swivel plate in a fixed path relative thereto along the grooves.

6. In the emergency lighting unit fixture of claim 5 and further comprising stop means formed integrally with the lamp assembly housing and abutting a projection extending from the concave face of the swivel plate in order to limit motion of the lamp assembly housing relative to the swivel plate along the track means.

7. In the emergency lighting unit fixture of claim 2 wherein the mounting means comprise ramp elements shaped to follow curvatures of rim portions of the swivel plate and being located along said rim portions of the swivel plate, the ramp elements each having an elongated arcuate slot formed therein at locations of the ramp elements adjacent to the rim portions of the swivel plate, the slots receiving edge portions of the housing which define the aperture which receives the swivel plate therein for swiveling motion relative to the housing on snap-fitting of the plate into the aperture.

8. In the emergency lighting unit fixture of claim 7 wherein the mounting means further comprise at least one tab element extending from the swivel plate beyond the rim portions of the plate and being disposed on a side of the swivel plate opposite the ramp elements, at least one tab element acting in concert with the ramp elements and the slots formed therein to hold the swivel plate within the aperture.

9. In the emergency lighting unit fixture of claim 2 wherein the lamp assembly further comprises:

a lamp assembly housing having a substantially cylindrical body portion open at one end and a rear wall shaped as a spherical segment congruent with the shape of the concave face of the swivel plate;

a bezel having a substantially cylindrical body portion and being open at each end and being received through one end of the cylindrical body portion of the lamp assembly housing and thus being mountable to the body portion of the lamp assembly housing for rotary motion relative to the lamp assembly housing;

adjustment means carried by the lamp assembly housing and the bezel and cooperating to hold the lamp assembly housing and the bezel together for relative movement therebetween to cause the bezel to respectively move toward or away from the lamp assembly housing on rotation of the bezel;

a reflector mounted by the bezel and having an aperture formed therein, shaped reflective surfaces of the reflector facing the open end of the bezel opposite that end of the bezel received into the cylindrical body portion of the lamp assembly housing;

a lens mounted by the bezel and closing the open end of the bezel opposite that end of the bezel received onto the cylindrical body portion of the lamp assembly housing;

a lamp comprising the illumination source and being mounted to the lamp assembly housing and connected through the lamp assembly housing and a swivel plate to the source of the emergency power located within the housing of the fixture, the lamp extending at least partially through the aperture formed in the reflector; and, a spring located between portions of the lamp assembly housing near the lamp and portions of the reflector near the aperture formed therein, the spring being in compression between the lamp assembly housing and the reflector, movement of the bezel relative to the lamp assembly housing through use of the adjustment means causing the lamp to be displaced relative to the reflective surfaces of the reflector, thereby to alter beam width of light emanating from the lamp assembly.

10. In the emergency lighting unit fixture of claim 9 wherein the adjustment means comprises arcuate thread elements formed on the cylindrical body portion of the lamp assembly housing and tab elements formed on the bezel, the tab elements of the bezel following the thread elements to allow relative movement therebetween.

11. In the emergency lighting unit fixture of claim 10 and further comprising stop means carried by the lamp assembly housing at respective ends of the thread elements to limit relative movement between the lamp assembly housing and the bezel.

12. In the emergency lighting unit fixture of claim 9 and further comprising knurl means formed on the bezel for facilitating gripping of the bezel manually for rotation of the bezel.

13. A lamp assembly mountable in an aperture formed in a housing of a lighting fixture, comprising:

a lamp assembly housing having a substantially cylindrical body portion open at one end and a rear wall shaped as a spherical segment;

a lamp mounted by the lamp assembly housing;

swivel means carried by the lamp assembly housing for mounting the lamp assembly housing to the fixture for swiveling movement relative to said fixture; and, track means carried by the lamp assembly housing and mounting the lamp assembly housing to the swivel means for movement relative to the swivel means.

14. The lamp assembly of claim 13 wherein the swivel means comprises:

a swivel plate shaped as a spherical segment and having one face which is concave in conformation, the opposite face of the swivel plate being received substantially within the aperture formed in the housing and being rotatable within the aperture, the spherical face of the swivel plate being congruent with the shape of the rear wall of the lamp assembly housing;

mounting means formed integrally with the swivel plate for mounting the plate within the aperture for rotary movement therein; and, track-following means formed integrally within the swivel plate for engagement with and movement along the track means.

15. The lamp assembly of claim 14 and further comprising stop means formed integrally with the swivel plate for limiting motion of the lamp assembly housing along the track means.

16. The lamp assembly of claim 14 wherein the track-following means comprise arcuate tabs spaced apart with one tab located on one face of the swivel plate and another tab being located on the same face of the swivel plate, the tabs being located on opposing sides of the swivel plate face, outermost ends of the tabs intersecting a periphery of the swivel plate, body portions of the tabs extending into the concavity of said face of the swivel plate.

17. The lamp assembly of claim 16 wherein the track means comprise spaced grooves formed in exterior surfaces of the rear cylindrical wall of the lamp assembly housing, the arcuate tabs being received one each into one each of the grooves to guide movement of the lamp assembly housing relative to the swivel plate.

18. The lamp assembly of claim 17 and further comprising stop means formed integrally with the lamp assembly housing for limiting movement between the lamp assembly housing and the swivel plate.

19. The lamp assembly of claim 14 wherein the mounting means comprise ramp elements shaped to follow curvatures of rim portions of the swivel plate and being located along the rim portions of the swivel plate, the ramp elements each having an elongated arcuate slot formed therein at locations of the ramp elements adjacent to the rim portions of the swivel plate, the slots receiving edge portions of the housing which define the aperture for receiving the swivel plate therein for swiveling motion relative to the housing on snap-fitting of the plate into the aperture.

20. The lamp assembly of claim 19 wherein the mounting means further comprise a tab element extending from the swivel plate beyond the rim portions of the plate and being disposed on a side of the swivel plate opposite the ramp elements, the tab element acting in concert with the ramp elements to hold the swivel plate within the aperture.

21. The lamp assembly of claim 14 wherein the lamp assembly further comprises:

a bezel having a substantially cylindrical body portion and being open at each end and receiving through one end thereof the cylindrical body portion of the lamp assembly housing and thus being mounted to the body portion of the lamp assembly housing for rotary motion relative to the lamp assembly housing;

adjustment means carried by the lamp assembly housing and the bezel and cooperating to hold the lamp assembly housing and the bezel together for relative movement therebetween to cause the bezel to respectively move toward or away from the lamp assembly housing on rotation of the bezel relative to the lamp assembly housing;

a reflector mounted by the bezel and having an aperture formed therein, shaped reflective surfaces of the reflector facing the open end of the bezel opposite that end of the bezel received onto the cylindrical body portion of the lamp assembly housing; and, a spring located between portions of the lamp assembly near the lamp and portions of the reflector near the aperture formed therein, the lamp extending at least partially through the aperture formed in the reflector, the spring being in compression between the lamp assembly housing and the reflector, movement of the bezel relative to the lamp assembly housing by use of the adjustment means causing the lamp to be displaced relative to the reflective surfaces of the reflector, thereby to alter beam width of light emanating from the lamp assembly.

22. The lamp assembly of claim 21 wherein the adjustment means comprises arcuate thread elements formed on the cylindrical body portion of the lamp assembly housing and tab elements formed on the bezel, the tab elements of the bezel following the thread elements to allow relative movement therebetween.

23. The lamp assembly of claim 22 and further comprising stop means carried by the lamp assembly housing at respective ends of the thread elements to limit relative movement between the lamp assembly housing and the bezel.

24. The lamp assembly of claim 21 and further comprising knurl means formed on the bezel for facilitating gripping of the bezel manually for rotation of the bezel.

25. The lamp assembly of claim 13 and further comprising means carried by the lamp assembly housing for adjusting beam widths of illumination emanating from the lamp assembly housing.

26. The lamp assembly of claim 13 wherein the lamp comprises a sealed beam lamp.

27. A lamp assembly mountable to a housing of a lighting fixture, the housing having an aperture formed therein, comprising:

a lamp assembly housing having a portion thereof shaped as a spherical segment;

a lamp mounted by the lamp assembly housing;

a swivel plate shaped as a spherical segment and having one face which is concave in conformation, the opposite face of the swivel plate being received substantially within the aperture formed in the housing and being rotatable within the aperture, the spherical face of the swivel plate being congruent with the shape of the portion of the lamp assembly housing which is shaped as a spherical segment; and, means for mounting the lamp assembly housing to the swivel plate for movement relative to the swivel plate.

28. The lamp assembly of claim 27 wherein the lamp comprises a sealed beam lamp.

29. The lamp assembly of claim 27 and further comprising means carried by the lamp assembly for adjusting beam widths of illumination emanating from the lamp assembly.

* * * * *